US005352304A

United States Patent [19]

DeArdo et al.

[11] Patent Number: 5,352,304

[45] Date of Patent: Oct. 4, 1994

[54] HIGH STRENGTH LOW ALLOY STEEL

[75] Inventors: Anthony J. DeArdo, Pittsburgh; Robert A. Walsh, Natrona Heights, both of Pa.

[73] Assignee: Allegheny Ludlum Corporation, Pittsburgh, Pa.

[21] Appl. No.: 976,879

[22] Filed: Nov. 16, 1992

[51] Int. Cl.[5] ..... C22C 38/42

[52] U.S. Cl. ..... 148/336; 148/328; 420/92; 420/91

[58] Field of Search ..... 148/328, 336; 420/91, 420/92, 119

[56] References Cited

U.S. PATENT DOCUMENTS

| | | | |
|---|---|---|---|
| 2,199,804 | 5/1940 | Matthes | 420/92 |
| 3,692,514 | 9/1972 | Hurley | 75/124 |
| 4,534,805 | 8/1985 | Jesseman | 148/328 |

OTHER PUBLICATIONS

"High Strength Low Alloy Steels in Naval Construction", Montemarano et al, Journal of Ship Production, vol. 2, No. 3, Aug. 1986, pp. 145–162.

"Cold Cracking in welds in HSLA Steels", Graville, *Welding of HSLA Steels,* ASM, Metal Park, Ohio, 1978.

"Structure, Hardenability and Toughness of Low-Carbon High-Strength Steels", McEvily et al, Transformation and Hardenability in Steels Sym., Feb. 27–28, 1967.

"Development of Controlled Rolled Ultra Low Carbon Bainite Steel for Large Diameter Linepipe", Nakasugi et al, Alloys for the Eighties, May 1980.

*Proceedings Accelerated Cooling on Rolled Steel,* Haze et al, Canadian Inst. Mining and Metallurgy, Pergammon, 1988, pp. 235–248.

"High Strength Low Alloy Steels: A Decade of Progress", Pickering, *Microalloying 75,* 1977, p. 9.

*Primary Examiner*—Deborah Yee

*Attorney, Agent, or Firm*—Patrick J. Viccaro

[57] ABSTRACT

A high strength low alloy steel having a yield strength of at least 100 ksi and a Charpy V-notch impact strength of at least 35 ft-lbs. at minus 84° C. (minus 120° F.) at thickness of up to 6 inches is provided wherein the steel consists essentially of an effective amount up to 0.036% carbon, for low temperature toughness up to 5% manganese, up to 1% silicon, up to 0.015% sulfur, 2 to 4% nickel, up to 2% copper, up to 0.1% niobium, and up to 0.1% aluminum, up to 4.% molybdenum, up to 4% chromium and the balance iron and incidental impurities and is characterized by low carbon bainite microstructure in the as-quenched condition.

11 Claims, 5 Drawing Sheets

HIGH STRENGTH LOW ALLOY STEEL

BACKGROUND OF THE INVENTION

This invention relates to low alloy precipitation hardened steels characterized by high strength and toughness in plate form. More particularly, this invention relates to copper precipitation hardened low alloy Ni-Cu-Cb steels having high strength, improved low temperature toughness, especially in thick sections, and excellent weldability resulting from low carbon and in some embodiments low sulfur content.

In the 1960's, the plate steels available for structural applications were either as-hot rolled C-Mn-Si steels with ferrite-pearlite (F-P) microstructures or quenched and tempered (QT) low alloy steels with tempered martensitic microstructures. The F-P steels exhibited yield strengths on the order of 60 ksi (413.7 MPa) while the QT steels had yield strengths in excess of 80 ksi (561.6 MPa). In both the F-P and the QT steels, the strength of the steel is derived from the carbon content. Unfortunately, while the carbon content is effective in imparting strength, it is also responsible for lower weldability and weldment properties.

One family of QT steels which is used in Navy ship and submarine construction is known as the HY (High Yield strength) steels; HY-80, HY-100, HY-130 and HY-180. Of particular interest here is HY-100 which has an allowable yield strength range of 100–120 ksi (689.5–827.4 MPa). A typical composition (wt.%) of HY-100 is 0.15 C-0.3 Mn-3.0 Ni-1.4 Cr-0.4 Mo. This steel is capable of being hardened by the QT treatment in section thicknesses in excess of 4 inches (10.2 cm). After the QT treatment, HY-100 can exhibit adequate levels of strength and toughness in the base plate. However, the combination of the relatively high carbon content and overall alloy content render this steel prone to hydrogen-related cracking in the heat-affected zone (HAZ) which develops during multi-pass welding of the plates. The problem of hydrogen-related HAZ cracking could be avoided only through the use of very expensive weld process controls such as preheating and restricted welding conditions.

To overcome such problems, high strength low alloy steels were developed having potentially the same or better strength and toughness properties and with a more easily welded microstructure. Generally, such steels were obtained by a combination of "clean" steel processing, controlled microalloying elements, and heat treatments. For example, U.S. Pat. No. 3,692,514, issued Sep. 19, 1972, discloses a low alloy steel adapted for structural and line pipe use. Such steel included alloying small amounts of columbium, vanadium, titanium, aluminum, boron, and nitrogen which functions in grain refinement and precipitation hardening to increase strength and toughness in a conventional carbon-manganese structural grade steel. Further increases in strength were achieved with nominal amounts of conventional alloying of copper, cobalt, nickel, and molybdenum along with proper heat treatment. Such steels exhibited improved weldability with less stringent controls such as eliminating preheating prior to welding. Although such steels were developed for line pipe, they also found applications in valves and fittings for pumping stations, off-shore platforms, oil well servicing equipment, large mining and off highway trucks, and also as structural plate for naval ships and submarine construction.

The use of such steels and the weldments in ships and vessels was directly related to the extraordinary toughness, high strength and deformation performance under high rate loading. Ordinarily used for general construction, such ferritic steels having high weldability were found suitable for ship construction. Welding of ships and vessels, however, is a very labor intensive process due principally to the design requirements of water tight integrity, compartmentation, and shock resistance, for example, and the difficulty of using automated welding in the majority of ship construction. A key advantage of high strength low alloy steels is the inherent weldability and the attendant lack of preheat requirement as part of the welding process. Such improved weldability directly translates into significant fabrication cost reductions while at the same time providing weight savings which can be achieved by the substitution of high strength steels in small cross sections. Such improved weldability is primarily attributed to the low carbon content, generally on the order of 0.04 to 0.08%. The problems, considerations and development work associated with higher strength steel plates for ship and vessel construction are described in the *Journal of Ship Production*, Vol. 2, No. 3, August 1986, pages 145–162.

The literature also contains many references concerning the influence of steel composition on final properties. In general it is well recognized that toughness is improved by lowering the amounts of certain elements contained in the steel, especially carbon and sulfur. A dramatic improvement in toughness with lower carbon levels of less than 0.04% is described in a paper entitled "Structure, Hardenability and Toughness of Low-Carbon High-Strength Steels" by McEvily, et al. reported in the symposium Feb. 27–28, 1967, "Transformation and Hardenability in Steels." The high yield strength (greater than 100 ksi) steels, nominally containing 3% Ni-3% Mo and 0.7% Mn, also exhibited high toughness in the as-rolled condition without further heat treatment to develop the strength and low temperature toughness.

There is ample information in the literature that both cold cracking resistance and HAZ toughness are reduced with increased carbon content. In FIG. 1 of an article by B.A. Graville, in *Proceedings Welding of HSLA-Microalloy Structural Steels*, ASM, 1978, pp. 85–101, susceptibility varied with both carbon content and carbon equivalent value. It was also noted that carbon content had the most important influence can susceptibility to cold cracking. Haze et al (T. Haze, S. Aihara and H. Mabuchi, in *Proceedings Accelerated Cooling of Rolled Steel*, Canadian Inst. Mining and Metallurgy, Pergammon, 1988, pp. 235–248) have shown in FIG. 2 that the low temperature toughness of the coarse-grained HAZ was reduced as the amount of high carbon martensite islands increased. During the intercritical annealing which occurs inadvertently in multipass welding, the amount of martensite which is present after cooling would increase linearly with the carbon content.

Lower carbon contents ranging from 0.01 to 0.03% in ultralow carbon bainitic (ULCB) steel have also been shown to improve weldability and toughness. A paper entitled "Development of Controlled Rolled Ultralow Carbon Bainitic Steel For Large Diameter Line Pipe" by H. Nakasugi, et al. from *Alloys for the* 80's, pages 13–14, discloses such a steel containing 1.5 to 2.0% manganese as well as nominally 0.04 niobium to achieve the strength and toughness in the steel. Such steels would not be suitable for ship plate because of strength and thickness L0 limitations.

The influence of the sulfur level on notch toughness is also well recognized at high temperatures where the upper shelf toughness is increased with lower sulfur.

What is needed is a high strength low alloy steel which can achieve mechanical properties which fall within prescribed narrow ranges, e.g., 100≦YS≦120 ksi (689.5 ≦YS≦827.4 MPa) and Charpy V-notch toughness CVN ≧35 ft. lbs. at −120° F. (−84° C.) for a wide range of plate thicknesses, e.g., 0.5–6.0 inches (1.3–15.2 cm). Furthermore, it is desirable that this steel be producable by straightforward steelmaking techniques. Still further, it is desirable that this steel exhibit improved weldability over a wide range of welding conditions, e.g., heat inputs and plate thicknesses. In addition, the weldments in this steel should be immune to cold and hydrogen cracking without preheating. Still further, the new steel should exhibit good strength and toughness in the HAZ.

SUMMARY OF THE INVENTION

In accordance with the present invention, an alloy steel is provided in which the tensile yield strength can be controlled within the range 100≦YS≦120 ksi at room temperature RT, and in which the CVN toughness ≧60 ft. lbs. at 0° F. (−18° C.) and ≧35 ft. lbs. at −120° F. (−84° C.) over a wide range of thickness.

The subject alloy steel can exhibit adequate mechanical properties after having been subjected to any one of a number of processes including hot rolling plus direct quenching, hot rolling plus direct quenching plus aging, hot rolling plus cooling plus reheating plus quenching plus aging, hot rolling plus cooling plus multiple heat treatments. It is intended that "cooling" means any rate of cooling such as furnace cooling through coiling, and water quenching.

The subject low alloy steel consists essentially of, by weight percent, up to 0.03 carbon, 0.5 to 1.5 manganese, up to 0.4 silicon, up to 0.006 sulfur, 3.0 to 4.0 nickel, 1.0 to 2.0 copper, 0.02 to 0.1 niobium, a small but effective amount of aluminum up to 0.1, up to 0.9 molybdenum, up to 1.2 chromium and the balance iron and incidental impurities. The alloy is characterized by a low carbon bainite microstructure in the as-quenched condition.

The uniqueness of the subject low alloy steel lies in its ability to exhibit controlled tensile and CVN properties in a variety of section thicknesses after being processed under uncomplicated processing conditions. This behavior is a result of the low levels of carbon (C≦ 0.03 wt. %) and sulfur (S≦ 0.005 wt. %). Lower levels of sulfur are preferred since the resistance to brittle fracture (ductile-brittle transition temperature-DBTT-in a CVN curve) in this steel improves with decreasing sulfur contents. While the resistance to ductile fracture (upper shelf energy of a CVN curve) is well known to increase with decreasing sulfur content, the DBTT is not normally considered to vary strongly with steel cleanliness, i.e., sulfur content. However, it was unexpectedly found that in these low carbon steels, low sulfur does have a marked beneficial influence on DBTT.

A further illustration of the uniqueness of the subject low alloy steel is evident when its response to processing and heat treatment are compared to similar steels with higher carbon contents. The benefits of low (0.03% C max.) versus high (0.035% C min.) carbon contents may be summarized as follows:

(i) In very thin sections (<0.75 inch) (<1.9 cm), the high carbon version cannot be softened during aging to yield strengths below the maximum required YS=120 ksi. The low carbon version can easily meet this requirement.

(ii) In moderately thick sections (1.0 ≦ t ≦2.0 inch) (2.5 ≦ t ≦5.1 cm) the high carbon version cannot meet the CVN properties required, especially in the mid-thickness regions. The required toughness in these high carbon versions may only be achieved by employing expensive and time consuming multiple and complex heat treatments (e.g., multiple austenitizing and quenching, multiple aging, quenching from the aging temperature). On the other hand, adequate levels of toughness can be obtained in the low carbon version with a single reheating, quench and age.

(iii) The low carbon version of the subject steel exhibits acceptable levels of strength and toughness following direct quenching from the final hot rolling temperature. Higher carbon versions are unacceptably strong and brittle in this condition and must be subsequently aged to exhibit acceptable properties.

(iv) Perhaps the most important feature of any plate steel is its response to welding, especially, in the case of multipass submerged-arc welding. The main problems normally encountered include cold cracking of the heat-affected zone (HAZ) and abnormally low toughness in the coarse-grained region of the HAZ. Since both of these problems can be reduced or eliminated by lowering the carbon content, both the weldability and weldment (HAZ) toughness can be expected to be improved in the steel of the present invention, especially when compared to prior art steel containing carbon from 0.035–0.070%.

Such findings establish that the lower carbon steels of the present invention are fundamentally different from the known high strength low alloy steels having carbon ranging up to 0.07%.

DETAILED DESCRIPTION OF THE PREFERRED EMBODIMENTS

Figure 1:
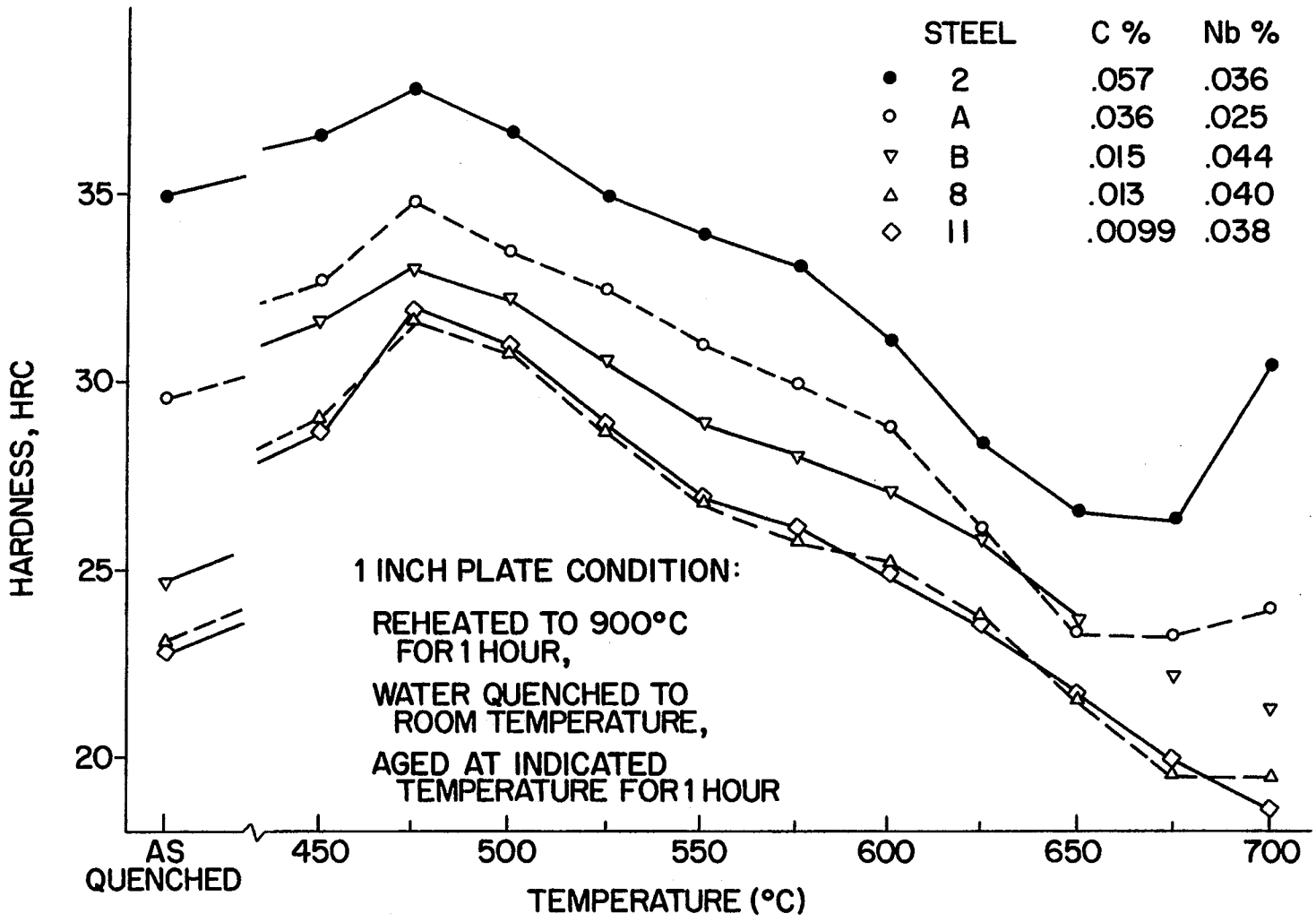
FIG. 1 illustrates hardness aging properties for steels at various carbon levels in a plot of hardness and temperature.

Broadly, the present invention is a high strength low alloy steel (HSLA) composition which can be made using conventional melt practices and which exhibits excellent properties in the base plate in either the quenched or quenched and aged condition. Furthermore, the present invention offers important benefits with respect to welding such as by both a high resistance to cold or underbead cracking and a good low temperature toughness of the HAZ. The enhanced properties in both the plate and HAZ achievable with a minimum of post-rolling heat treatment are a result of low carbon contents up to 0.03% maximum and controlled sulfur up to 0.006% maximum. Such low carbon and sulfur levels, which are below those found in commercially available plate products, result in a plate product that does not require additional heat treatments such as aging to attain strength, toughness, or weldability.

To achieve the higher levels of yield strengths on the order of 100 ksi or greater, work has been done by others indicating that increased amounts of Ni, Mo, and Cu must be present. Nickel must be present in the steel to increase the toughness and provide a contribution to strength due to solution strengthening and grain refinement. At least 1.0% nickel, and advantageously at least about 2.0% nickel is necessary. Although nickel has been found to be beneficial in preventing cracking during hot rolling, if the nickel content appreciably exceeds 4%, the alloy steels of the present invention would have a tendency to form austenitic transformation products. The nickel may range from 2.5% or 3.0% up to about 4.0% and preferably from 3.3 to 3.7% to achieve the desired strength and toughness.

Manganese is present in amounts broadly ranging from 0.3 to 5.0% but as a practical matter may range from 0.5 to 1.5% and preferably from 0.7 to 1.1%. The manganese addition serves to tie up sulfur so as to avoid fabricating difficulties such as cracking during hot rolling and to reduce the formation temperature of the transformation products. The manganese can also provide solid solution strengthening of the ferrite. Manganese in amounts of greater than 1.5 would adversely affect steelmaking efficiencies and greater than 5% would further affect the cost of such steel.

Copper is an element which contributes to the strength of the alloy of the present invention by lowering the transformation temperature and by permitting precipitation hardening. Copper may range up to 2% and preferably is an essential element from at least 1 to 2% and should not be present in amounts in excess of 2% which would tend to cause cracking during hot rolling. Preferably copper ranges from 1.4 to 1.8% to achieve the desired strengthening through precipitation hardening.

To achieve optimum strength and toughness, niobium (i.e., columbium) is important ranging up to 0.1% and should be present in amounts of at least about 0.02% up to about 0.1%. Preferably, niobium may range from 0.02 to 0.06%. Niobium is present to contribute to strength by lowering the transformation temperature and to contribute to toughness by promoting grain refinement in the parent austenite phase. Excessive amounts of niobium may adversely affect impact toughness, particularly at lower temperatures.

The steel must contain sufficient amounts of Cu-Ni-Nb for control of the bainite phase starting temperature during processing. Chromium and molybdenum may be present to optimize the precipitation of the copper generally by suppressing the aging process as is known in prior art steel alloys. Although the alloy of the present invention has excellent toughness properties in the as-quenched condition, i.e., without aging, both chromium and molybdenum still may be beneficial to the alloy of the present invention. Both chromium and molybdenum contribute to the strength of the alloy. Molybdenum may range up to 4%, preferably up to 0.9% and more preferably from 0.4 to 0.9%, when present. Chromium may range up to 4%, preferably up to 1.2% and more preferably ranges from 0.4 to 0.9%, when present. Silicon may range up to 1%, preferably up to 0.4 or 0.5% and is present to provide additional solid solution strengthening.

An important feature of the present invention is the range of carbon present. The ultralow carbon content of the present invention contributes to the excellent toughness at low temperatures in fully processed material, i.e., hot rolled, reheated, quenched, and aged. The ultralow carbon content also permits the attainment of acceptable yield strength ($100 \leqq YS \leqq 120$ ksi) and toughness (60 ft. lbs. at 0° F. and $\geqq 35$ ft. lbs. at $-120°$ in base plate with abbreviated processing, i.e., in the as-quenched condition after either rolling or after reheating after rolling. In addition, both the weldability (resistance to cold cracking) and HAZ toughness at low temperatures are enhanced by the low carbon content of the present invention. Carbon may range from a small but effective amount, up to 0.036% preferably on the order of about 0.01% up to about 0.036%. More preferably, the carbon may range up to 0.03% and preferably 0.01 to 0.025%. The steel of the present invention has an ultralow carbon level lower than that typically found in HY-series and other HSLA-series steels made to date. Typically, such prior art steels of more recent vintage may have carbon ranging from 0.035 to 0.045%. Commercial specifications for such high strength low alloy steels, e.g., HSLA-80, and HSLA-100, however, indicate that the carbon level may range up to a maximum of 0.07 weight percent.

Although the lower carbon content does not adversely influence the strength level of the steel, which is chiefly controlled through the aging process, it does have an expected improvement on weldability. Surprisingly, however, the lower carbon content has a remarkable effect on the notch toughness at low temperatures especially in thick sections as is required by the U.S. Navy specifications for shipplate. Such stringent low temperature notch toughness is achieved where commercial high strength low alloy steels either cannot, or may do so only after very expensive and time consuming multiple heat treatment processes.

Although there is no intent to be bound by theory, it appears that there may be three possible explanations for the significant effect of the ultralow carbon levels. First, the solubility of carbon in the bainitic ferrite at temperatures where the bainite is aged to produce copper precipitates may be important. For example, carbon content below the solubility limit may minimize the initiation of microcracks. If the carbon content exceeds the solubility limit in the ferrite at the aging temperature, the supersaturated carbon may form hard carbide particles which can act as initiation sites for microcracks during deformation.

A second possible explanation may be in the incomplete transformation of the austenite to bainite during the high temperature portion of the transformation. The untransformed austenite might transform to a high carbon martensite or martensite-austenite (M-A) constituent at lower temperatures later in the quench. Such high carbon martensite or martensite-austenite constituent may also be partly responsible for poorer toughness in high strength low allow steels containing higher carbon contents on the order of at least 0.035 or more. Lower carbon results in less M-A constituent and therefore higher toughness.

A third explanation may be the surprising discovery that such steels with less than 0.030%, especially less than 0.025% carbon, have a low carbon bainite microstructure in The as-quenched condition. Steels having higher carbon of at least 0.035% or more have low carbon martensitic microstructure, as-quenched. The more ductile low carbon bainite microstructure may partially account for the improved properties.

An advantage of the ultralow carbon content of the steel of the present invention is that the as-quenched plates do not need to be subjected to further heat treatments and aging to attain either the appropriate yield strength range (100≦YS≦120 ksi) or to develop the excellent toughness at low temperatures. The prior art steels require aging to temper the martensite or martensite-austenite constituent which occurs along with the precipitation of copper.

In a preferred embodiment of the invention, the ultralow carbon steel also contains lower sulfur contents than normally found in the prior art steels. Although the benefits of lower sulfur contents are generally known such as for improving the upper shelf toughness, i.e., Charpy V-notch toughness at higher temperatures, other benefits have been discovered when used with the ultralow carbon contents of the steel of the present invention. Generally, sulfur may be present up to 0.015%, preferably up to 0.006% and still provide a steel having the improved properties characteristic of the alloy of the present invention. Preferably, however, the sulfur is maintained at low levels preferably up to 0.003% and more preferably up to 0.002%. It has been found that the low sulfur content improves the low temperature toughness of the steel when used in combination with the ultralow carbon content.

Optionally, additions of calcium and/or rare earth elements, such as cerium, or other rare earths typically found in Mischmetal may be used. Such rare earths and calcium which is sometimes grouped with rare earths would tend to tie up sulfur, or take sulfur out of solution, or to control the shape of the sulfur compounds. The effect of the rare earths is to reduce the number of particles in the steel which could present points of initiation of ductile or brittle cracks during deformation of the steel. The total rare earths used may range up to 0.03%; higher levels may be detrimental.

Figure 3:
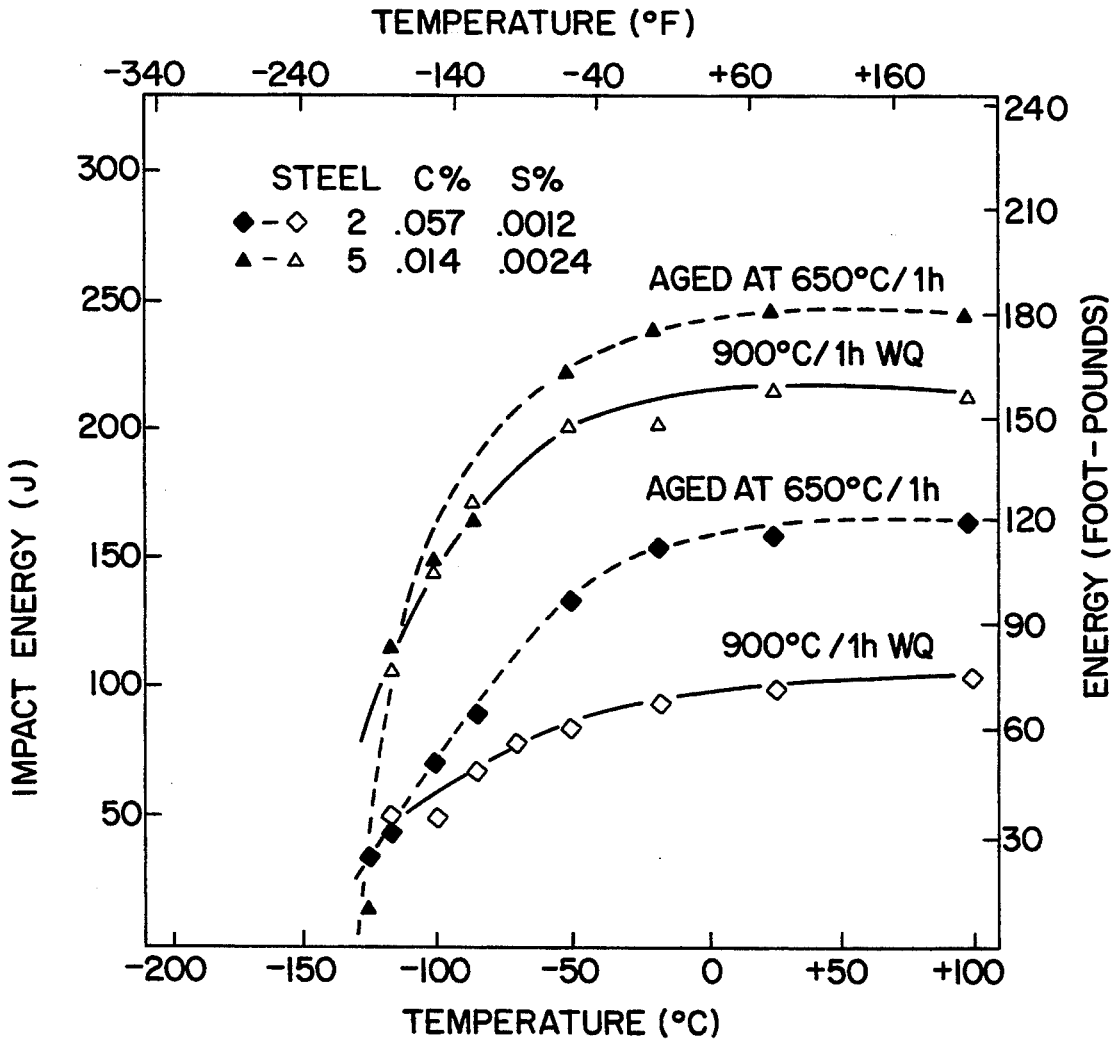
FIG. 3 illustrates the influence of C and heat treatment on mechanical properties in a plot of impact toughness versus temperature.
Figure 4:
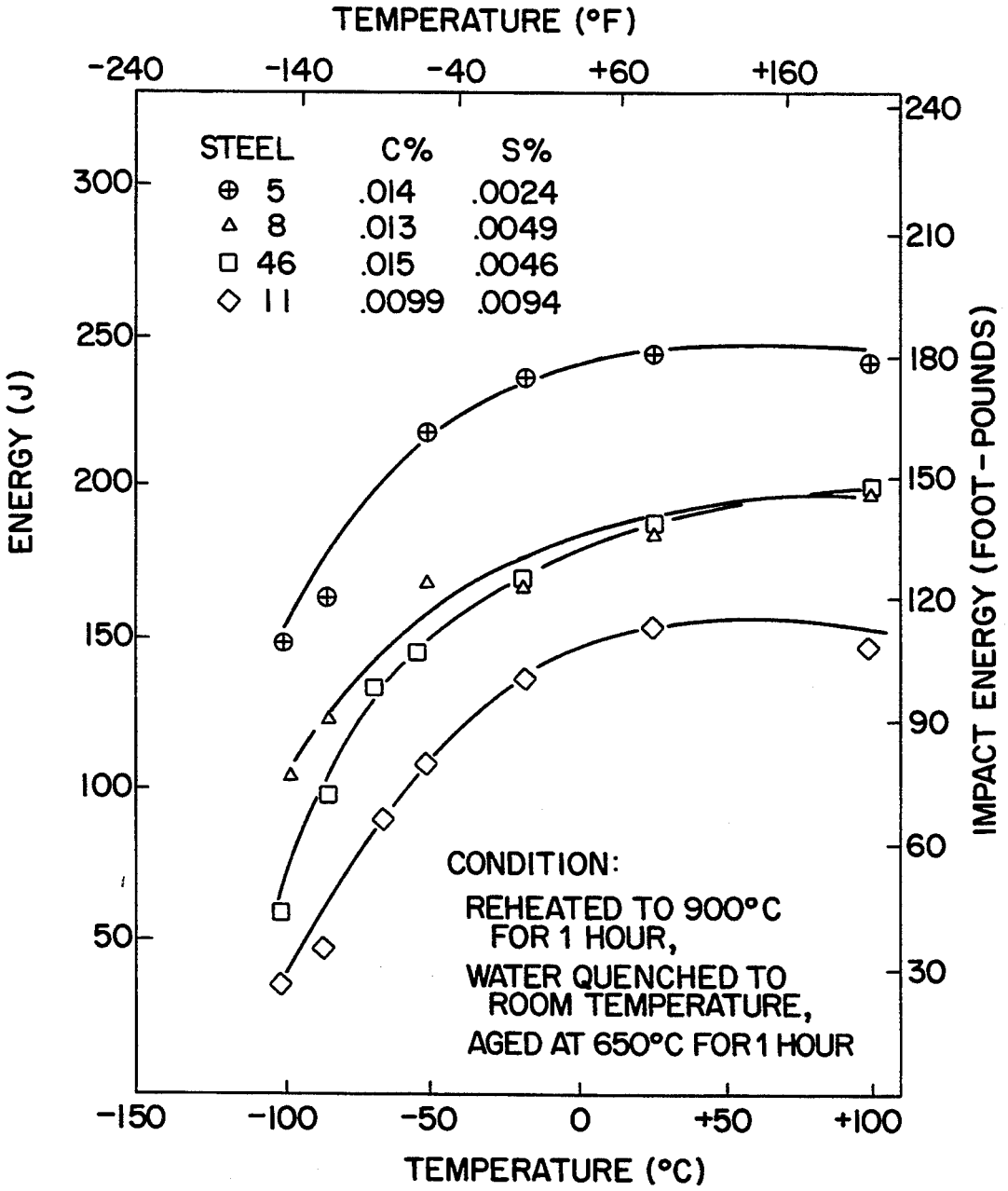
FIG. 4 illustrates the influence of S content and heat treatment on mechanical properties in a plot of impact toughness.

The synergistic effect as shown in FIGS. 3 and 4 between the low sulfur and ultralow carbon contents is an overall improvement in toughness over a wide range of temperatures such as from minus 150° F. to plus 100° F. (minus 101° to 38° C.).

The remainder of the steel of the present invention is the balance of iron and incidental impurities and residuals resulting from steelmaking processes. Such constituents may include deoxidizing and cleansing elements as well as impurities normally associated with steelmaking which would not adversely affect the basic characteristics of the alloy. Aluminum is a deoxidizing agent or impurity which may be present up to 0.1% maximum preferably up to 0.04%. Phosphorus is an impurity which may be present up to 0.04% maximum, preferably up to 0.02%.

In the practice of producing the alloy of the present invention, an advantage is that conventional melting and processing practices may be used without the need for expensive and time consuming multiple heat treatments for producing plates up to 4 inches (10.2 cm) thick. Prior art steels of this type cannot be manufactured with adequate properties in thicknesses above 1.5 inches (3.8 cm), and even those had to be subjected to special heat treating processes to achieve adequate properties. Furthermore, prior art steels of this type cannot be heat treated to attain the required range of yield strengths (100≦YS≦120 ksi) in thin sections, less than 0.50 inches (1.3 cm). This is because adequate overaging is not possible in steels with carbon contents exceeding 0.04%.

Generally, in the practice of producing the steel of the present invention, the alloy may be melted using any conventional melting practices such as the basic oxygen furnace (BOF), argon-oxygen-decarburization (AOD), and vacuum induction melting (VIM). The steel melt may be cast into ingots or continuously cast into slabs and then subsequently hot-rolled to final plate thickness. For high-strength low-alloy steels of the type of which the present steel is an improvement, conventional heat treat processing includes reheating the plate for purposes of austenitizing. Such reheating may occur from any temperature in excess of approximately 1500° F. (816° C.) for times approximated by "one hour-per-inch of thickness", typically a reheating treatment for a one-inch plate would be one hour at 1650° F. (900° C.). Thereafter the plate is water quenched until black, i.e., until fully bainitic or fully transformed. By "water quenching" it is meant that any quenching means may be used which would result in cooling the steel plate at a rate of cooling that is substantially faster than air cooling, and, preferably, would approach or equal the cooling rate achieved in a direct water quench for the given plate thickness and reheating temperature.

Thereafter, conventional processing would include an additional low temperature heat treatment for "aging" the steel. The aging treatment is an integral part of the processing of the prior art steels of this type. The aging treatment is required to reduce the high as-quenched yield strength to a level that falls within the acceptable range. Furthermore, the aging process causes the toughness of the prior art steels of this type to be increased from a low as-quenched value to an acceptable value. The aging process is not a necessary part of the processing of the present invention since the as-quenched values of yield strength and toughness are both of acceptable magnitudes. When aging is used, it includes heating the steel to a temperature in the range of 932° F. (500° C.) to 1382° F. (750° C.), holding the steel at that temperature for approximately "one hour-per-inch of thickness", and then cooling to room temperature either by air cooling or water quenching. Other rates of cooling may also be appropriate. A typical aging treatment for a one inch thick (2.5 cm) plate would be approximately 1201° F. (650° C.) for one hour.

Although the present invention described in detail has utility with HY and HSLA steels generally, the heats in the examples have the following nominal composition, except as noted:

TABLE V

| Mn | Si | Cr | Ni | Al | Mo | Cu | Cb | Fe |
|---|---|---|---|---|---|---|---|---|
| 1.0 | .38 | .62 | 3.5 | .05 | .6 | 1.69 | .038 | Bal. + residuals |

In order to better understand the present invention, the following examples are presented:

EXAMPLE I

Since this type of steel is normally used in the quenched and aged condition, it is important to know the influence of carbon content on the response of this type of steel to aging. FIG. 1 illustrates the aging curves for steels of various carbon contents ranging from 0.0099 to 0.057. In this experiment, steels of various C and Nb compositions for HSLA 100 steels were produced generally as described above. One inch plate specimens were austenitized for one hour at 900° C. and WQRT. The specimens were then aged for 1 hour at each aging temperature. The aging curves shown in FIG. 1 illustrate two significant trends. First, the as-quenched hardness increases with the carbon content and this increment is carried through to the as-aged hardness. Second, the aging behavior with increasing aging temperature varies with carbon content at temperatures above 650° C. The low carbon steels ($C \leqq 0.015\%$) exhibit a monotonically decreasing aging curve with increasing aging temperature from the peak near 475° C. to 700° C. The higher carbon steels ($C \geqq 0.036\%$), on the other hand, show an increase in hardness with increasing aging temperature near 650° C. While the low carbon steels can be overaged from 475° to 700° C., the higher carbon steels can be overaged only between 475° to 650° C. This is a significant and important difference since the aging temperature is used to control the strength of the final product and to enable various thicknesses to obtain yield strengths in the range 100–120 ksi which is often required. Hence, it would be difficult or impossible to have the yield strength of thin plates of the prior art steel be lowered through overaging yet fall within the specified range. This prior art problem is overcome by this invention because of its continuous overaging behavior, as will be demonstrated later.

The variation in as-quenched hardness is also of significance since this is a predictor of the steel to be used in the hot rolled and direct-quenched condition The very high hardness level exhibited after reheating the WQRT in the higher carbon versions indicates that the strength after hot rolling and direct quenching may be too high, i.e., above 120 ksi YS, to be used without aging. The lower hardness level shown by the lower carbon steel of the present invention suggests that this steel may possibly be used in the rolled and direct quenched condition. This will be demonstrated in a later example.

EXAMPLE II

Figure 2:
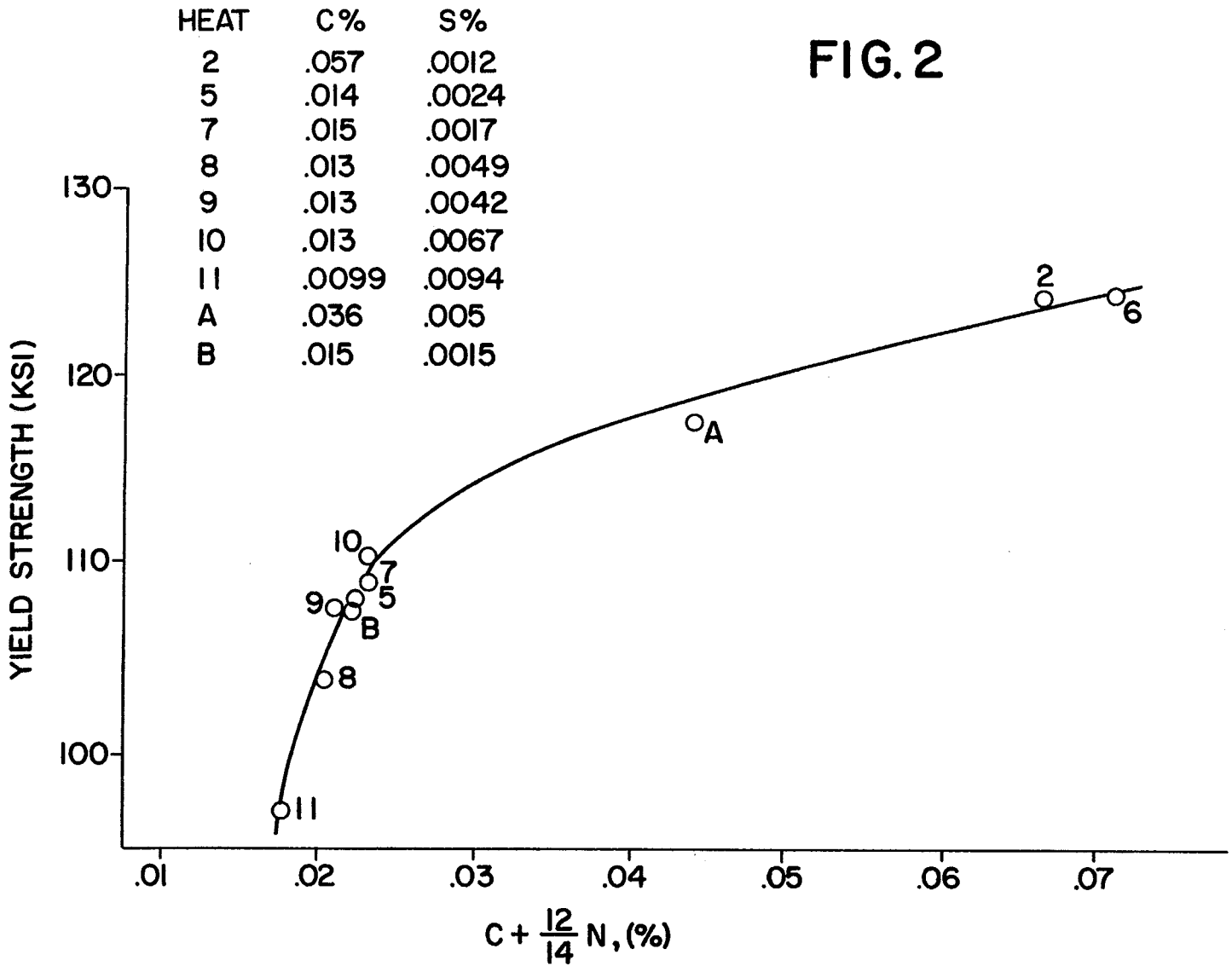
FIG. 2 is a plot illustrating the influence of C and N on the yield strength of quenched-and-aged steel.

The low carbon steel of the present invention is fundamentally different from the prior art steels as shown in FIG. 2. The data in FIG. 2 represents the yield strengths for various steels after constant heat treatment plotted as a function of their respective interstitial contents. It is clear from FIG. 2 that there is a fundamental change in strengthening mechanisms with increasing carbon plus nitrogen content near $[C+(12N/14)] = 0.025$. At lower interstitial levels, the slope of the curve is approximately 2600 ksi/$[C+(12N/14)]$ while the slope at higher interstitial levels is approximately 210 ksi/$[C+(12N/14)]$. These slopes indicate that the interstitials are adding to the strength of the various steels in different ways. The very high slope at low interstitial levels indicates that the interstitials are most probably contributing to strength by solid solution hardening whereas the lower slope at higher interstitial contents indicates strengthening by a less effective mechanism, perhaps precipitation hardening. (See F.B. Pickering, Microalloying 75, "High Strength Low Alloy Steels: A Decade of Progress," p. 9, 1977.)

Additionally, in FIG. 2, the break in the curve at $[C+(12N/14)] = 0.025$ may also signify the limit of solid solubility of carbon and nitrogen in ferrite at the aging temperature, and that the maximum carbon content permissible in this new invention may be approximately defined in this way. The higher interstitial levels in the prior art steels may lead to the formation of undesirable second phases which can degrade ductility and toughness, both in the base plate and HAZ in weldmerits.

EXAMPLE III

A third example of the unique character of the present invention is in the response of this type of steel to quenching, either after reheating to the usual austenitizing temperature (about 1650° F.), or from, at, or near the finish rolling temperature (i.e., direct quenching). The influence of carbon content on the properties of one inch thick specimens which had been reheated and quenched, with or without subsequent aging, is shown in Table I. While all four steels can meet both the strength ($100 \leqq YS \leqq 120$ ksi) and toughness ($CVN \geqq 35$ ft. lbs. @ −85° C.) requirements in the quenched-and-aged condition, only the steel of the present invention can also meet these properties in the as-quenched condition.

TABLE I

MECHANICAL PROPERTIES AFTER REHEATING AND QUENCHING, WITH AND WITHOUT AGING OF HOT ROLLED PLATES

| HEAT | CONDITION | YS ksi | UTS ksi | CVN TOUGHNESS (FT.-LBS.) @ ROOM TEMP. | −18° C. | −84° C. |
|---|---|---|---|---|---|---|
| A | AS-QUENCHED | 115 | 144 | 54 | 55 | 29 |
| (.036C | AGED | 117 | 121 | 97 | 88 | 47 |
| .005S) | | | | | | |
| B | AS-QUENCHED | 107 | 123 | 168 | 156 | 94 |
| (.015C | AGED | 114 | 119 | 191 | 184 | 90 |
| .0015S) | | | | | | |
| 2 | AS-QUENCHED | 132 | 165 | 72 | 69 | 49 |
| (.057C | AGED | 124 | 129 | 117 | 116 | 65 |
| .0012S) | | | | | | |
| X | AS-QUENCHED | 132 | 170 | — | 49 | 28 |
| (.060C | AGED | 125 | 129 | — | 112 | 59 |
| .002S) | | | | | | |

UTS = Ultimate Tensile Strength

In a similar study, the influence of carbon content: on the properties of one inch (2.5 cm) thick plates was determined for both the direct quenched and reheated, quenched-and-aged conditions. These data are shown in Table II. Once again, all of the steels were able to meet the required strength .and toughness when in the reheated, quenched and aged condition. However, once again, the steel of the present invention having less than 0.036 carbon is the only version of this grade which can meet the required properties in the direct quenched condition.

TABLE II

MECHANICAL PROPERTIES OF HOT ROLLED PLATES AFTER EITHER DIRECT QUENCHING OR AFTER REHEATING, QUENCHING, AND AGING

| % CARBON OF STEEL | CONDITION | YS ksi | UTS ksi | CVN, TOUGHNESS (FT-LB @ −18° C. | −84° C. |
|---|---|---|---|---|---|
| .02 | HR + WQ | 117 | 127 | 147 | 65 |
| | HR + RHT + WQ + Age | 104 | 112 | 131 | 102 |
| .017 | HR + WQ | 114 | 132 | 97 | 67 |
| | HR + RHT + WQ + Age | 107 | 116 | — | 75 |
| .045 | HR + WQ | 136 | 154 | 52 | 27 |
| | HR + RHT + WQ + Age | 111 | 120 | 124 | 84 |
| .059 | HR + WQ | 144 | 165 | 55 | 32 |
| | HR & RHT + WQ + Age | 109 | 124 | 104 | 73 |

WQ = Water quench to room temperature
RHT = Reheat to 900° C. for 1 hour
Age = Aging at 650° for 1 hour

EXAMPLE IV

The essence of the present invention is that within the broad definition of HSLA 100 steel, there exists no continuum of final properties with variation in carbon content within the specified range. In fact, the low carbon version (C≦0.036%) of this steel is both radically different from and superior to the higher carbon (C≧0.036%) versions.

As indicated above, the major properties of interest in the base plate are the YS (100≦YS≦120 ksi) and the notch toughness (CVN≧35 ft. lbs. @ −120° F.). FIG. 1 demonstrated that, for a given base composition, the strength level is governed chiefly by the aging temperature and is influenced by the C content only to a minor degree. It is very important to realize that achieving adequate strength in these steels is rather simple, since they are always heat treated to the heavily overaged condition. In fact, reducing the YS to below 120 ksi is at least as difficult, and possibly more difficult, than exceeding the 100 ksi minimum level. Hence, the low carbon version of the steel cannot only easily exceed the minimum YS, but can also easily be overaged to fall below the maximum as well.

The influence of C content on notch toughness is not as benign, as is shown in FIG. 3, where full CVN transition curves are presented. In this case, two steels with different C contents (0.014 and 0.057%) were tested in the reheated and quenched (i.e., 900° C./1h WQ) and the reheated, quenched-and-aged conditions (i.e., aged to 650° C./1h). Three important facts emerge from FIG. 3. First, the low carbon steel has much higher toughness in either condition. Second, aging improves the toughness of the higher carbon steel dramatically, while it has only a minor effect on the lower carbon steel. Third, the higher carbon steel is, in fact, out of the specified strength range. There is no doubt that the low temperature toughness of the higher carbon steel, which is just barely in the acceptable range in FIG. 3, can be further improved through the use of exotic and expensive additional heat treatments such as multiple reheating and quenching treatments and/or multiple aging treatments. Although these additional treatments do work in reducing the YS and increasing the toughness of the higher carbon steel, it is very important to note that these additional treatments are not needed in the lower carbon steel. Hence, the steel of the present invention may be described as requiring few, uncomplicated processing steps in order to meet the required properties.

Just as the lower carbon version is superior to the higher carbon version, a distinction in sulfur level is also important. Traditionally, the S level has been thought to materially affect toughness only when the fracture process involved ductile fracture. Ductile fracture in a CVN transition curve typically involves the upper shelf energy, fracture occurring in specimens tested at higher temperatures, e.g., room temperature. Sulfur, therefore, is not normally associated with low temperature toughness. The influence of sulfur content on the CVN transition curves of the steel of the present invention is shown in FIG. 4. Each steel was reheated, quenched, and aged at 900° C./1h, WQ, then 650° C./1h. It is obvious that the sulfur content has a dramatic effect on both high and low temperature toughness levels in this steel. Hence, S should be kept as low as possible within the specified range. Furthermore, inclusion altering additives such as calcium may be added to further improve the toughness.

Figure 5A:
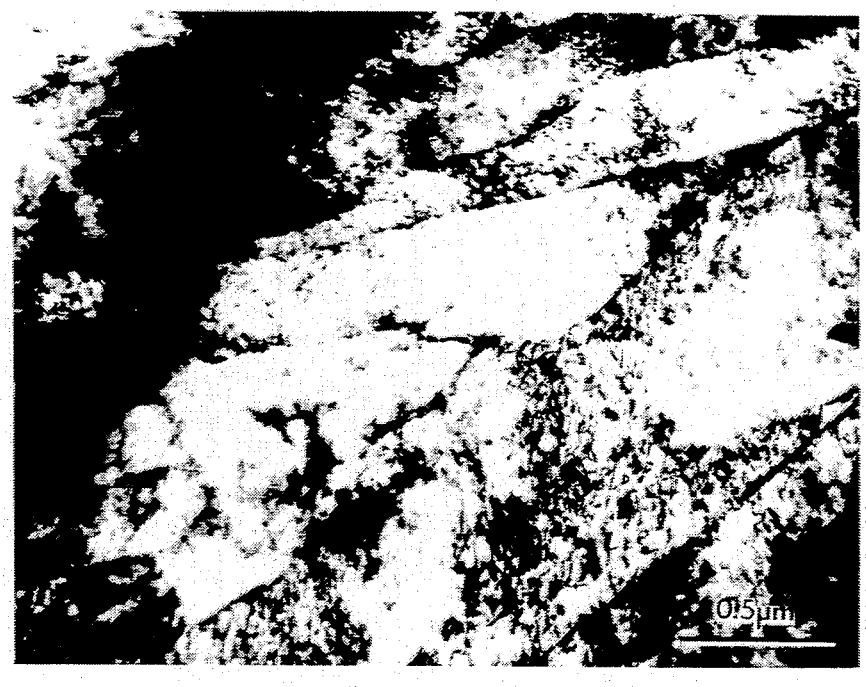
FIG. 5A is a photomicrograph which exhibits low carbon lower bainite microstructure of the alloy of the present invention.
Figure 5B:
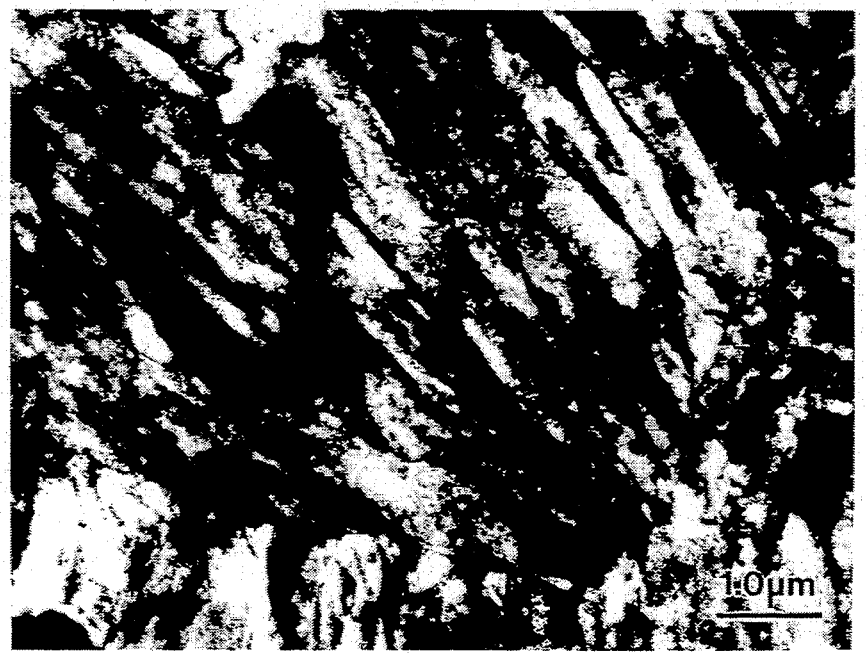
FIG. 5B is a photomicrograph which exhibits the low carbon martensitic microstructure of prior art alloys.

The distinctions in microstructure of lower carbon and higher carbon specimens are shown in FIGS. 5A and 5B. FIG. 5A is a transmission electron micrograph of an alloy of the present invention having 0.015 carbon exhibiting a low carbon lower bainite microstructure. FIG. 5B is a photomicrograph of a 0.036 carbon containing steel exhibiting the low carbon martensite microstructure typical of prior art alloys.

This difference in microstructure is directly caused by the difference in hardenability which is related to the difference in carbon content. It is very well known that carbon is an extremely powerful hardenability agent. The steel with 0.015 C does not have sufficient hardenability to form martensite during the quench; instead, it forms bainite. The higher carbon versions of the steel have sufficient hardenability to form martensite during the quench and, in fact, form martensite. The difference in structure is directly related to the difference in carbon content.

Martensite and bainite are very different microstructures, even though they both exhibit lath-shaped subgrains. Low carbon martensite forms as a supersaturated solid solution of carbon in highly dislocated, very fine ferrite laths which have a body centered tetragonal crystal structure. The lath boundaries often contain layers of retained austenite. Bainite forms as a highly dislocated, somewhat coarser lath structure with no carbon supersaturation and with a body centered cubic crystal structure. No retained austenite is associated with the inter-lath boundaries. Carbides are often found within the bainite laths.

Not only are the microstructures different between martensite and bainite, but so are the responses of aging following quenching. When martensite is aged (tempered), the carbon supersaturation is relieved through the formation ε-carbides and/or cementite ($Fe_3C$). Furthermore, the films of retained austenite at the martensite boundaries are converted to new martensite or carbide. Low carbon lower bainite does not undergo these transformations during aging; the response to aging is also different.

EXAMPLE V

Three production heats of the steel of the present invention were melted and hot rolled to a variety of plate thicknesses. Each production heat composition was similar to the nominal composition, except for about 0.015 carbon and 0.002 sulfur. The first and third heats were melted in a Basic Oxygen (BOF) furnace while the second was melted in a Vacuum Induction Melting (VIM) furnace. The properties of heat treated specimens taken from one inch (2.5 cm) thick plate are shown in Table III. All plates were reheated at 1650° C. for 1 hour, water quenched, then aged 1 hour at 1200° F. It is clear that not only are the properties quite uniform and largely independent of processing route used, but also that the toughness at −120° F. is excellent even with the use of a single, simple reheating, quenching and aging treatment.

TABLE III

AGING PROPERTIES OF 1.0 INCH PLATE OF THE PRESENT INVENTION

| PRODUCTION ROUTE | MECHANICAL PROPERTIES YS ksi | UTS ksi | RA % | CVN TOUGHNESS (FT-LB) @ −18° C. | −84° C. |
|---|---|---|---|---|---|
| BOF-1 | 114.0 | 119.0 | 72.6 | 184.0 | 90.0 |
| VIM-1 | 112.4 | 117.7 | 74.0 | 178.0 | 140.0 |
| BOF-2 | 113.0 | 117.0 | 72.4 | 178.0 | 140.0 |

RA = Reduction in Area

EXAMPLE VI

The influence of carbon content on the response to aging shown in FIG. 1 indicates that the steel of the present invention is capable of being overaged over virtually the entire range of aging temperatures. The higher carbon versions (i.e., C≧0.036%), on the other hand, can only be overaged to about 1200° F., above which temperature the steel begins to harden. This difference in overaging behavior has little apparent significance in moderate-to-heavy plate gages (t≧1.0 inch) (t≧2.5 cm), but is of considerable importance in light gage plates (t≦0.5 inch) (t≦1.3 cm).

The strength exhibited after heat treatment is a function of both the as-quenched properties and the change in those properties with aging. The as-quenched hardness or strength will vary with both carbon content, as shown in FIG. 1, and with the quench rate. Hence, high carbon contents and high quench rates will result in very high as-quenched strengths. Conversely, low carbon contents and slow quench rates would result in relatively low as-quenched strengths. The most interesting case is when a low carbon variant is quenched at a high rate. Since the response to quench rate is very sensitive to carbon content, one would not expect a high asquenched hardness or strength with a low carbon version even with a high quench rate. This relative insensitivity to quench rate, when taken with the well behaved response to aging, means that the steel of the current invention can be used to make thin plate with acceptable properties whereas the higher carbon versions cannot.

TABLE IV

AGING PROPERTIES OF 0.5 INCH PLATE OF THE PRESENT INVENTION

| PRODUCTION ROUTE | HEAT TREATMENT | MECHANICAL PROPERTIES YS ksi | UTS ksi | RA % | CVN TOUGHNESS (FT-LB) @ −18° C. | −84° C. |
|---|---|---|---|---|---|---|
| BOF-2 | Reheat, quench + age @ 1184° F. (640° C.) | 112 | 117 | 77.5 | 189 | 169 |
| BOF-2 | Reheat, quench + age @ 1229° F. (666° C.) | 100 | 113 | 77.0 | 185 | 166 |

One plate from the second BOF heat was hot rolled to a thickness of 0.5 inch (1.3 cm). Samples of this plate were then reheated for one hour at 1650° F., quenched and aged for one hour at either 1184° F. or 1229° F. The resulting properties are shown in Table IV. Two important points emerge from Table IV. First, even with the higher quench rates expected with the 0.5 inch specimens, strengths within the required range are easily attainable. Second, since the samples aged at 1229° F. (666° C.) have a lower strength than those aged at 1184° F. (640° C.), the aging behavior predicted from the hardness curves of FIG. 1 is, in fact observed. This indicates that even thinner steels can be overaged to fall within the required yield strength range (100≦YS≦120 ksi). It is unlikely that higher carbon steels in this range of thickness can be softened sufficiently during overaging to have their strengths fall within the required range. These higher carbon steels could be made to exhibit the required properties if they were subjected to more complex and costly heat treatments.

EXAMPLE VII

One of the most important factors responsible for attaining high toughness at low temperatures is the size of the austenite grains present prior to final transformation. High toughness at low temperatures is associated with small austenite grains. The austenite grain size of interest here is that which exists after the reheating stage (i.e., after 1650° F., one hour) prior to quenching during the typical heat treatment which follows hot rolling. One of the major parameters influencing this grain size is the scale of the microstructure which exists in the as-rolled plate which is being reheated. Hot rolled plates with fine, final microstructures will yield fine austenite grains after reheating while coarse, final microstructures will yield coarse austenite grains. Hence, it is extremely difficult, if not impossible, to have good low temperature toughness in a single iteration of reheat-quench-and age in plates of heavy gage. This is because the coarse microstructure typical of thick hot rolled plates is carried through the subsequent heat treatment into the final product. This dilemma is typically resolved by using a multiple reheating and quenching treatment prior to aging. It is well known that the benefits of austenite grain refinement imparted by controlled rolling and cooling techniques become impractical or impossible at heavier plate thicknesses, e.g., in the range of one to two inches. Therefore, at heavier thicknesses other methods of grain refinement must be employed. Since the ability to control rolling is not related to the carbon content, heavy gauge steels of all carbon contents would have to be given multiple heat treatments to insure adequate low temperature toughness.

This technique was applied to a plate from the second BOF heat of the steel of the present invention which had been rolled to a thickness of 2.5 inches (6.6 cm). The mechanical properties of this material in several heat treated conditions are shown in Table V. Since both the magnitude of mechanical properties and their variation through the thickness of heavy plate are important, properties at the surface, quarter thickness and mid-thickness were determined. Clearly, the double austenitizing and quenching treatment prior to aging has a dramatic effect on the low temperature toughness observed. Not only was this toughness extremely high, but it was also remarkably uniform throughout the thickness. The data of Table V illustrate that the steel of the present invention is easily capable of achieving acceptable strength levels in thicker plate, and, most remarkably, is able to attain extremely high and uniform levels of low temperature toughness through the application of multiple heat treatments.

TABLE V

AGING PROPERTIES OF 2.5 INCH PLATE OF THE PRESENT INVENTION

| HEAT TREATMENT | | YS ksi | UTS ksi | RA % | CVN TOUGHNESS (FT-LB) @ −84° C. |
|---|---|---|---|---|---|
| Reheat + quenched + aged at 1184° F. | S | 115 | 120 | 78.0 | 12.5 |
| | QP | 114 | 119 | 76.6 | 14.0 |
| | C | 114 | 119 | 76.5 | 10.0 |
| Reheat + quenched + reheat + quenched & aged at 1184° F. | S | 110 | 114 | 77.2 | 155.0 |
| | QP | 107 | 111 | 78.7 | 148.0 |
| | C | 107 | 112 | 76.5 | 146.0 |

Note:
S = Surface
QP = Quarter thickness
C = Center thickness

EXAMPLE VIII

The weldability of a plate steel is perhaps its most important property since it affects the intrinsic fabricability of the steel. It is well known, for example, that the cost of welding usually exceeds the cost of the steel in the manufacture of large, complex engineering structures. Hence, the weldability of a plate steel is an integral part of its overall suitability and cost effectiveness as a structural material.

There are two components to the weldabilty cf a steel. The first deals with the actual welding characteristics of the steel or the ability to form sound welds using efficient, standard welding techniques. These welds must be sound not only immediately after welding but also must remain sound. The second is concerned with the mechanical properties of the final weldment which includes the fusion line in addition to the coarse and fine-grained regions of the heat-affected zone (HAZ).

One of the major causes of defects in welds is the hydrogen inadvertently introduced into the fusion line during welding. This hydrogen, when coupled with the shrinkage stresses accompanying welding, can lead to hydrogen embrittlement and the phenomenon variously described as under bead, delayed or cold cracking of otherwise sound weldments. The susceptibility of a weldment, especially the coarse-grained region of the HAZ, is strongly dependent upon microstructure. For a given thermal cycle during welding, the microstructure will vary with base plate composition, hence, the susceptibility to cold cracking will also be strongly dependent upon base plate composition. The relationship between plate composition and susceptibility to cold cracking is well established. See 1978 Graville which noted that the carbon content had the most important influence on susceptibility to cold cracking.

Perhaps the most important mechanical property required in large engineering structures such as naval ships and submarines and in off-shore platforms is a high resistance to brittle fracture in the most vulnerable portion of the structure, i.e., the coarse-grained portion of the HAZ in the welded plates. Recent investigations, such as the 1988 Haze et al article cited above, have shown that the low temperature toughness of the coarse-grained HAZ is improved with a lowering of the carbon content of the base plate.

Since both the weldability and weldment toughness improve with lower carbon content, the steel of the current invention would be expected to be markedly superior to the higher carbon versions in both of these areas.

As was the objective of the present invention, a high strength low alloy steel having improved CVN impact properties at low temperatures in thick sections has been demonstrated. Such steels can be manufactured using no special steelmaking equipment and using conventional melting and processing parameters. Unexpectedly an advantage of the steel of the present invention is its excellent toughness over a wide temperature range in order to provide a steel having superior impact properties without an additional aging step, i.e., in the as-quenched condition. The improvement in processing avoids the expense and time associated with multiple heat treatments. It has been further found that the high strength low alloy steel has room temperature yield strengths of 100 to 120 ksi. A further advantage is the retained and improved weldability of the alloy due to its low carbon content, as shown in the literature (Graville and Haze et al), thus requiring no pre- or post-weld heating steps to achieve high CVN impact toughness in the HAZ even after multiple passes. Another advantage is that the steel meets the impact toughness and yield strength in plate form at thin gauges as low as 0.5 inch (1.3 cm) up to a thickness of about 6 inches (15.2 cm).

Although several embodiments of the present invention have been shown and described, it will be apparent to those skilled in the art that modifications may be made therein without departing from the scope of the invention.

What is claimed is:

1. An alloy steel having a tensile yield strength of 100,000 to 120,000 pounds per square inch at room temperature, and a CVN impact toughness of at least 35 ft-lbs. at minus 84° C. at a thickness of up to 6 inches in the as-quenched condition, the steel consisting essentially of, by weight percent, up to 0.006 sulfur and an effective amount up to 0.03 carbon for low temperature toughness, 0.7 to 1.1 manganese, up to 0.4 silicon, 3.3 to 3.7 nickel, 1.4 to 1.8 copper, 0.02 to 0.06 niobium, aluminum up to 0.1, up to 0.9 molybdenum, up to 1.2 chromium, and the balance iron and incidental impurities, said alloy having a low carbon bainite microstructure in the as-quenched condition.

2. The steel of claim 1 having an effective amount up to 0.025 carbon for low temperature toughness, 0.8 to 1.0 manganese, up to 0.4 silicon, up to 0.003 sulfur, 3.3 to 3.7 nickel, 1.4 to 1.8 copper, 0.03 to 0.06 niobium, aluminum up to 0.06, 0.4 to 0.9 molybdenum, and 0.4 to 0.9 chromium.

3. The steel of claim 1 further having calcium and/or rare earth additions up to 0.06 to combine with sulfur to improve the steel toughness.

4. The steel of claim 1 having up to 0.025 carbon and up to 0.003 sulfur.

5. The steel of claim 1 having a small but effective amount up to 0.015 carbon.

6. The steel of claim 1 having at least 0.01 up to 0.025 carbon for bainite phase stability.

7. The steel of claim 1 further characterized by a CVN impact toughness of at least 60 ft-lbs. at minus 18° C.

8. The steel of claim 1 in the form of plate in thicknesses of 0.5 to 3 inches.

9. The steel of claim 1 having improved weldability without pre- or post-weld heating.

10. An alloy steel plate up to 3 inches thick having a tensile yield strength of 100,000 to 120,000 pounds per square inch at room temperature, and a CVN impact toughness of at least 60 ft-lbs. at minus 18° C. and 35 ft-lbs. at minus 84° in the as-quenched condition, the steel alloy consisting essentially of, by weight percent, up to 0.004 sulfur, 0.7 to 1.1 manganese, up to 0.4 silicon, 3.3 to 3.7 nickel, 1.4 to 1.8 copper, 0.02 to 0.06 niobium, a small but effective amount each of carbon up to 0.03 for low temperature toughness and aluminum up to 0.1, up to 0.9 molybdenum, up to 0.9 chromium, and the balance iron and incidental impurities.

11. An alloy steel having been quenched and aged, and having a tensile yield strength of 100,000 to 120,000 pounds per square inch at room temperature, and a CVN impact toughness of at least 35 ft-lbs. at minus 84° C. at a thickness of up to 6 inches in the as-quenched condition, the steel consisting essentially of, by weight percent, up to 0.006 sulfur and an effective amount up to 0.015 carbon for low temperature toughness, 0.5 to 1.5 manganese, up to 0.4 silicon, 3.0 to 4.0 nickel, 1.0 to 2.0 copper, 0.02 to 0.01 niobium, aluminum up to 0.1, up to 0.9 molybdenum, up to 1.2 chromium, and the balance iron and incidental impurities, said alloy having a low carbon bainite microstructure in the as-quenched condition.

* * * * *